US006264529B1

(12) United States Patent
Logue

(10) Patent No.: US 6,264,529 B1
(45) Date of Patent: Jul. 24, 2001

(54) ALTERNATING BREAST NURSING SYSTEM

(76) Inventor: Rita K. Logue, 896 N. Callahan, Boise, ID (US) 83704

( * ) Notice: Subject to any disclaimer, the term of this patent is extended or adjusted under 35 U.S.C. 154(b) by 0 days.

(21) Appl. No.: 09/687,085

(22) Filed: Oct. 13, 2000

(51) Int. Cl.[7] ..... A41C 3/04
(52) U.S. Cl. ..... 450/36; 450/1

(58) Field of Search ..... 450/36, 1, 37, 450/38, 57, 58, 79; 2/73, 104

*Primary Examiner*—Gloria M. Hale

(57) ABSTRACT

An alternating breast nursing system for facilitating nursing from each breast alternately between feedings during breast-feeding of an infant. The alternating breast nursing system includes a pair of fasteners, each coupled to an associated cup of a nursing bra and a indicator couplable alternately to a selectable one of the fasteners to indicate which breast should be used next for feeding.

16 Claims, 2 Drawing Sheets

ALTERNATING BREAST NURSING SYSTEM

BACKGROUND OF THE INVENTION

1. Field of the Invention

The present invention relates to nursing bras and more particularly pertains to a new alternating breast nursing system for facilitating nursing from each breast alternately between feedings during breastfeeding of an infant.

2. Description of the Prior Art

The use of nursing bras is known in the prior art. More specifically, nursing bras heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,423,734; U.S. Pat. No. 5,092,812; U.S. Pat. No. 5,094,647; U.S. Pat. No. Des. 351,492; U.S. Pat. No. 1,136,727; and U.S. Pat. No. 3,634,178.

While these devices fulfill their respective, particular objectives and requirements, the aforementioned patents do not disclose a new alternating breast nursing system. The inventive device includes a pair of fasteners, each coupled to an associated cup of a nursing bra and a indicator couplable alternately to a selectable one of the fasteners to indicate which breast should be used next for feeding.

In these respects, the alternating breast nursing system according to the present invention substantially departs from the conventional concepts and designs of the prior art, and in so doing provides an apparatus primarily developed for the purpose of facilitating nursing from each breast alternately between feedings during breastfeeding of an infant.

SUMMARY OF THE INVENTION

In view of the foregoing disadvantages inherent in the known types of nursing bras now present in the prior art, the present invention provides a new alternating breast nursing system construction wherein the same can be utilized for facilitating nursing from each breast alternately between feedings during breastfeeding of an infant.

The general purpose of the present invention, which will be described subsequently in greater detail, is to provide a new alternating breast nursing system apparatus and method which has many of the advantages of the nursing bras mentioned heretofore and many novel features that result in a new alternating breast nursing system which is not anticipated, rendered obvious, suggested, or even implied by any of the prior art nursing bras, either alone or in any combination thereof.

To attain this, the present invention generally comprises a air of fasteners, each coupled to an associated cup of a nursing bra and a indicator couplable alternately to a selectable one of the fasteners to indicate which breast should be used next for feeding.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new alternating breast nursing system apparatus and method which has many of the advantages of the nursing bras mentioned heretofore and many novel features that result in a new alternating breast nursing system which is not anticipated, rendered obvious, suggested, or even implied by any of the prior art nursing bras, either alone or in any combination thereof.

It is another object of the present invention to provide a new alternating breast nursing system that may be easily and efficiently manufactured and marketed.

It is a further object of the present invention to provide a new alternating breast nursing system that is of a durable and reliable construction.

An even further object of the present invention is to provide a new alternating breast nursing system which is susceptible of a low cost of manufacture with regard to both materials and labor, and which accordingly is then susceptible of low prices of sale to the consuming public, thereby making such alternating breast nursing system economically available to the buying public.

Still yet another object of the present invention is to provide a new alternating breast nursing system which provides in the apparatuses and methods of the prior art some of the advantages thereof, while simultaneously overcoming some of the disadvantages normally associated therewith.

Still another object of the present invention is to provide a new alternating breast nursing system for facilitating nursing from each breast alternately between feedings during breastfeeding of an infant.

Yet another object of the present invention is to provide a new alternating breast nursing system which includes a pair of fasteners, each coupled to an associated cup of a nursing bra and a indicator couplable alternately to a selectable one of the fasteners to indicate which breast should be used next for feeding.

Still yet another object of the present invention is to provide a new alternating breast nursing system that provides a simple method of determining which breast has been most recently used for feeding and which breast is to be used next for feeding.

Even still another object of the present invention is to provide a new alternating breast nursing system that is applicable to an existing nursing bra or may be employed as an integral part of nursing bras during production.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
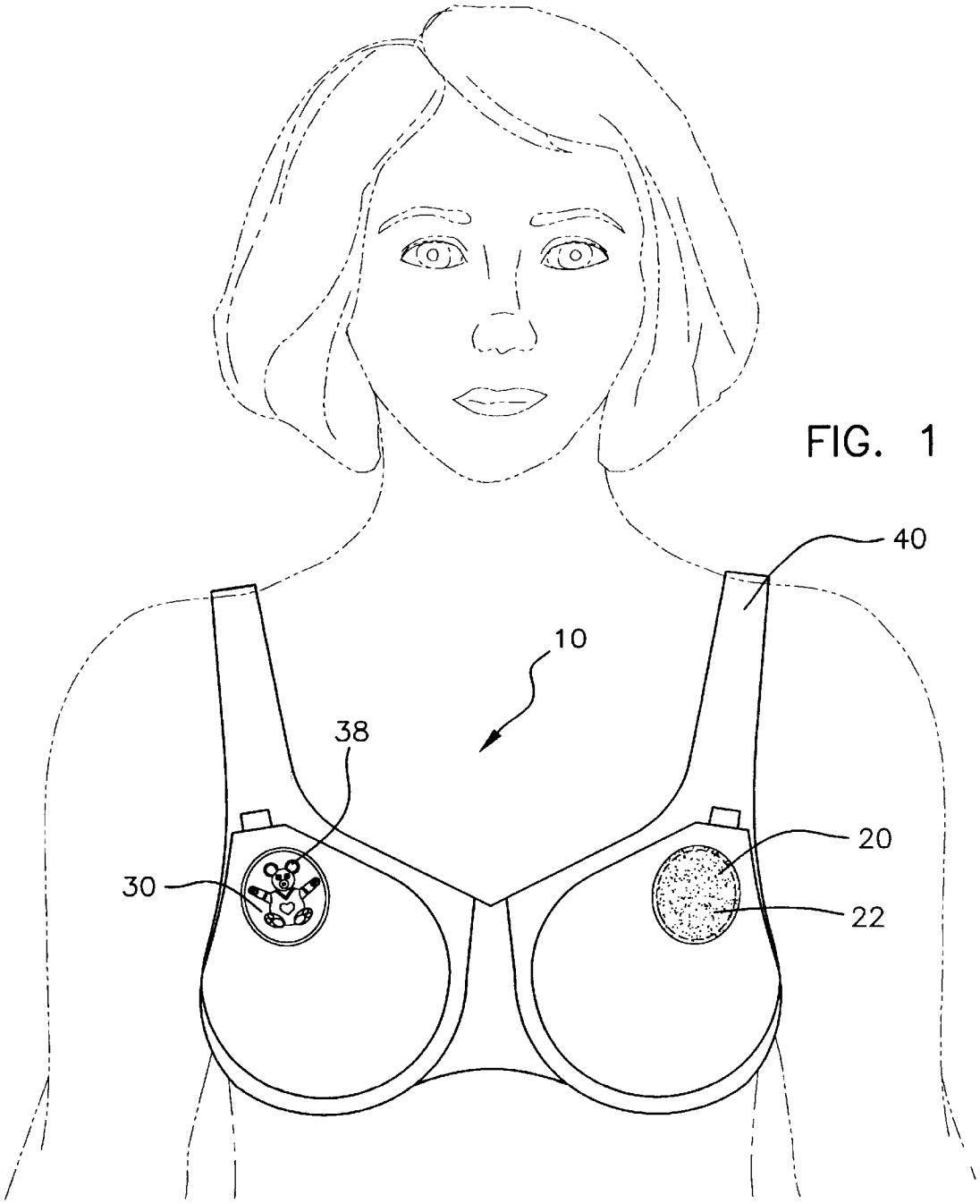
FIG. 1 is a front view of a new alternating breast nursing system according to the present invention.
Figure 2:
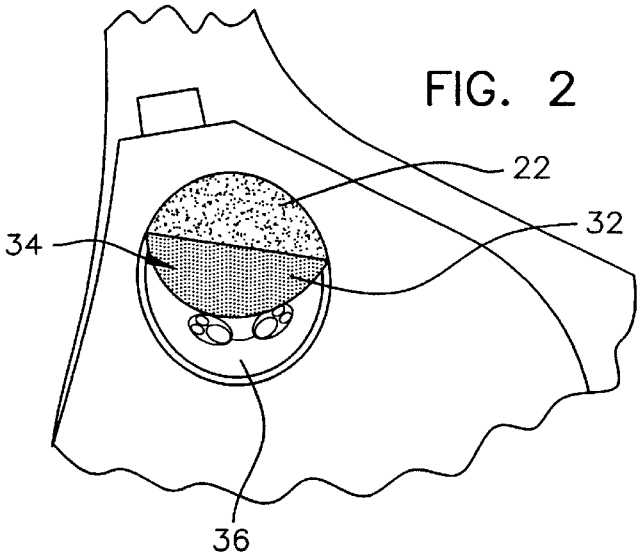
FIG. 2 is an enlarged front view of the indicator of the present invention.
Figure 3:
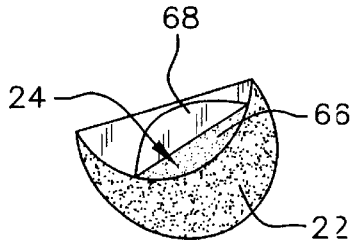
FIG. 3 is a front view of the fastener of the present invention.
Figure 4:
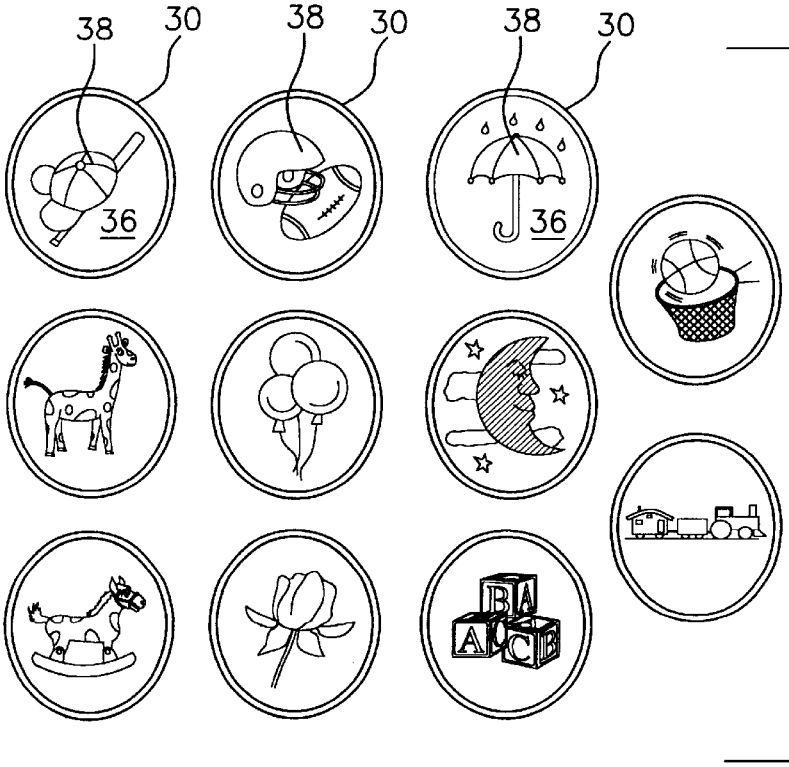
FIG. 4 is a front view of decorative indicators of the present invention.

With reference now to the drawings, and in particular to FIGS. 1 through 4 thereof, a new alternating breast nursing system embodying the principles and concepts of the present invention and generally designated by the reference numeral 10 will be described.

As best illustrated in FIGS. 1 through 4, the alternating breast nursing system 10 generally comprises a pair of fasteners 20 and an indicator 30. Each fastener 20 is designed for coupling to a respective side of a nursing bra 40.

The indicator 30 is selectively couplable to a selectable one of the fasteners 20 for facilitating determination of a breast preferred for use when breastfeeding to insure alternating between breasts from feeding to feeding.

In an embodiment, each of the pair of fasteners 20 is a portion of loop fastener 22. Thus each fastener 20 is designed for preventing snagging on a garment covering the nursing bra 40. A portion of hook fastener 32 is coupled to a rearward surface 34 of the indicator 30. Thus the indicator 30 is selectively engageable to a selectable one of the fasteners 20.

The indicator 30 is preferably constructed of a flexible material for enhancing comfort during use.

In an embodiment, the indicator 30 includes decorative indicia 38 on an outer face 36 of the indicator 30 for facilitating drawing attention of a user to the indicator 30 for facilitating alerting the user from which breast to feed, particularly when the user is near insensate due to lack of sustained sleep. A plurality of designs are usable. Further, the system 10 may provide several indicators 30, each having different indicia for providing a selectable design as desired by the user.

In an embodiment, each fastener is provided separate from the nursing bra 40 and includes a heat activated adhesive 66 coupled to a rearward face 24 of the fastener 20. Thus, each fastener 20 is designed for coupling to an existing nursing bra using an iron. A pair of backing members 68 would be provided. Each backing member 68 is removably engaged to an associated one of the fasteners 20 for covering the heat activated adhesive 66 prior to coupling of the fastener 20 to the nursing bra 40.

In an embodiment, the nursing bra 40 includes a pair of cups 42 positioned for covering a pair of breasts of the user. Each of the cups 42 is openable to expose the breasts to permit breastfeeding from a selectable one of the breasts. Each cup 42 of the nursing bra 40 includes a tab member 44 for facilitating opening of each cup 42. Each fastener 20 is coupled proximate an associated one of the tabs 44 for facilitating noticing of a position of the indicator 30 when opening a selected one of the cups 42.

In use, the fasteners are either applied to a nursing bra or a nursing bra having a pair of fasteners integrally incorporated into the bra may be provided. The indicator is coupled to a desired one of the fasteners to indicate which breast is preferred for the next feeding. Depending on the preference of the user, the preferred breast may be indicated by positioning the indicator on the side of the preferred breast or on the side opposite the preferred breast. Upon each incidence of breastfeeding, the indicator is moved from one side to the other. For consistency it is recommended that the indicator be moved either immediately prior to breastfeeding or immediately after breastfeeding depending on the preference of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An alternating breast nursing system comprising:

a pair of fasteners, each fastener being adapted for coupling to a respective side of a nursing bra;

an indicator selectively couplable to a selectable one of said fasteners for facilitating determination of a breast preferred for use when breastfeeding to insure alternating between breasts from feeding to feeding: and each fastener being coupled to an upper portion of an associated one of said cups of said nursing bra to facilitate viewing of said indicator by a wearer of the nursing bra.

2. The alternating breast nursing system of claim 1, further comprising:

each of said pair of fasteners being a portion of loop fastener whereby each fastener is adapted for preventing snagging on a garment covering the nursing bra.

3. The alternating breast nursing system of claim 2, further comprising:

a portion of hook fastener coupled to a rearward surface of said indicator whereby said indicator is selectively engageable to a selectable one of said fasteners.

4. The alternating breast nursing system of claim 1, further comprising:

said indicator being constructed of a flexible material for enhancing comfort during use.

5. The alternating breast nursing system of claim 1, further comprising:

said indicator including decorative indicia on an outer face of said indicator for facilitating drawing attention of the wearer to said indicator for facilitating alerting the wearer from which breast to feed.

6. An alternating breast nursing system comprising:

a nursing bra adapted for being worn by a user;

said nursing bra having a pair of cups positioned for covering a pair of breasts of the user, each of said cups being openable to expose the breasts to permit breastfeeding from a selectable one of the breasts;

a pair of fasteners, each of said fasteners being coupled to an associated side of said nursing bra;

an indicator selectively couplable to a selectable one of said fasteners for facilitating determination of a breast preferred for use when breastfeeding to insure alternating between the breasts from feeding to feeding; and each fastener being coupled to an upper portion of an associated one of said cups of said nursing bra to facilitate viewing of said indicator by a wearer of the nursing bra.

7. The alternating breast nursing system of claim 6, further comprising:

each of said pair of fasteners being a portion of loop fastener whereby each fastener is adapted for preventing snagging on a garment covering the nursing bra.

8. The alternating breast nursing system of claim 7, further comprising:

a portion of hook fastener coupled to a rearward surface of said indicator whereby said indicator is selectively engageable to a selectable one of said fasteners.

9. The alternating breast nursing system of claim 6, further comprising:

said indicator being constructed of a flexible material for enhancing comfort during use.

10. The alternating breast nursing system of claim 6, further comprising:

said indicator including decorative indicia on an outer face of said indicator for facilitating drawing attention of the wearer to said indicator for facilitating alerting the wearer from which breast to feed.

11. The alternating breast nursing system of claim 6, further comprising:

each cup of said nursing bra having a tab member positioned proximate a top of said cup for facilitating opening of each said cup;

each fastener being coupled proximate an associated one of said tabs for promoting physical contact with said indicator when said indicator is coupled to said associated one of said cups for facilitating noticing of a position of said indicator when opening a selected one of said cups to provide a tactile confirmation of use of the preferred breast.

12. The alternating breast nursing system of claim 1, further comprising:

each cup of said nursing bra having a tab member positioned proximate a top of said cup for facilitating opening of each said cup;

each fastener being coupled proximate an associated one of said tabs for promoting physical contact with said indicator when said indicator is coupled to said associated one of said cups for facilitating noticing of a position of said indicator when opening a selected one of said cups to provide a tactile confirmation of use of the preferred breast.

13. The alternating breast nursing system of claim 1, further comprising:

each said fastener having a heat activated adhesive coupled to a rearward face of said fastener whereby each said fastener is adapted for coupling to the nursing bra using an iron.

14. The alternating breast nursing system of claim 13, further comprising:

a pair of backing members, each backing member being removably engaged to an associated one of said fasteners for covering said heat activated adhesive prior to coupling of said fastener to the nursing bra.

15. An alternating breast nursing system comprising:

a nursing bra adapted for being worn by a user;

said nursing bra having a pair of cups positioned for covering a pair of breasts of the user, each of said cups being openable to expose the breasts to permit breastfeeding from a selectable one of the breast;

a pair of fasteners, each of said fasteners being coupled to an associated side of said nursing bra;

an indicator selectively couplable to a selectable one of said fasteners for facilitating determination of a breast preferred for use when breastfeeding to insure alternating between the breasts from feeding to feeding;

each of said pair of fasteners being a portion of loop fastener whereby each fastener is adapted for preventing snagging on a garment covering the nursing bra;

a portion of hook fastener coupled to a rearward surface of said indicator whereby said indicator is selectively engageable to a selectable one of said fasteners;

said indicator being constructed of a flexible material for enhancing comfort during use;

said indicator including decorative indicia on an outer face of said indicator for facilitating drawing attention of a user to said indicator for facilitating alerting the user from which breast to feed;

each fastener being coupled to an associated one of said cups of said nursing bra to facilitate viewing of said indicator by a wearer of the nursing bra;

each cup of said nursing bra having a tab member positioned proximate a top of said cup for facilitating, opening of each said cup;

each fastener being coupled proximate an associated one of said tabs for promoting physical contact with said indicator when said indicator is coupled to said associated one of said cups for facilitating noticing of a position of said indicator when opening a selected one of said cups to provide a tactile confirmation of use of the preferred breast.

16. The alternating breast nursing system of claim 1, further comprising:

each of said pair of fasteners being a portion of loop fastener whereby each fastener is adapted for preventing snagging on a garment covering the nursing bra;

a portion of hook fastener coupled to a rearward surface of said indicator whereby said indicator is selectively engageable to a selectable one of said fasteners;

said indicator being constructed of a flexible material for enhancing comfort during use;

said indicator including decorative indicia on an outer face of said indicator for facilitating drawing attention of a user to said indicator for facilitating alerting the user from which breast to feed;

each said fastener having a heat activated adhesive coupled to a rearward face of said fastener whereby each said fastener is adapted for coupling to the nursing bra using an iron;

a pair of backing members, each backing member being removably engaged to an associated one of said fasteners for covering said heat activated adhesive prior to coupling of said fastener to the nursing bra.

* * * * *